US006539856B2

(12) United States Patent
Jones et al.

(10) Patent No.: US 6,539,856 B2
(45) Date of Patent: Apr. 1, 2003

(54) METHOD OF SCREEN PRINTING STENCIL PRODUCTION

(75) Inventors: John W. Jones, Wantage (GB); David Joseph Foster, Swindon (GB)

(73) Assignee: Autotype International Limited (GB)

( * ) Notice: Subject to any disclaimer, the term of this patent is extended or adjusted under 35 U.S.C. 154(b) by 0 days.

(21) Appl. No.: 09/929,570

(22) Filed: Aug. 14, 2001

(65) Prior Publication Data

US 2002/0027125 A1 Mar. 7, 2002

Related U.S. Application Data

(63) Continuation of application No. 09/250,188, filed on Feb. 16, 1999, now abandoned.

(30) Foreign Application Priority Data

Feb. 17, 1998 (GB) ..... 9803334

(51) Int. Cl.[7] ..... B41C 1/14

(52) U.S. Cl. ..... 101/128.21; 101/128.4; 347/103

(58) Field of Search ..... 101/128.21, 128.4; 347/96, 102, 103; 430/308; 427/143, 271, 273

(56) References Cited

U.S. PATENT DOCUMENTS 4,254,194 A * 3/1981 Merrill et al. ..... 101/128.21
4,477,557 A * 10/1984 Rauch ..... 427/143

(List continued on next page.)

FOREIGN PATENT DOCUMENTS

| | | |
|---|---|---|
| CA | 2088400 | 1/1994 |
| EP | 0 108 509 | 5/1984 |
| EP | 0 492 351 A1 | 7/1992 |
| EP | 0 588 399 A1 | 3/1994 |
| EP | 0 635 362 A1 | 1/1995 |
| EP | 0 672 268 A1 | 9/1995 |
| EP | 0 710 552 A2 | 5/1996 |
| EP | 0 883 026 A1 | 12/1998 |
| GB | 180778 | 6/1922 |
| GB | 1431462 | 4/1976 |
| GB | 2 329 611 A | 3/1999 |
| WO | 97/43122 | 11/1997 |
| WO | 99/02344 | 1/1999 |

OTHER PUBLICATIONS

Advertisement from Gerber Scientific Products for "Screen-Jet"—Screen Imaging System for Textile Screenprinting ©1992 Gerber Scientific Products, Inc.

Publication from Screen Process dated Aug. 1997 entitled Latest Situation and Current Facts on Electronic Stencil Making by Thomas Schweizer et al.

Publication from Lüscher by Thomas Schweizer, et al dated Jan. 1996.

Publication from Lüscher by Thomas Schweizer dated Aug. 1996.

Publication from The Printers Forum entitled "Industrial Screen Printing using the new JetScreen Technology" by Thomas Schweizer, et al. dated Aug. 12, 1996.

*Primary Examiner*—Leslie J. Evanisko
(74) *Attorney, Agent, or Firm*—Wall Marjama & Bilinski LLP

(57) ABSTRACT

A coated film product comprises a support base, a stencil-forming layer and an intermediate release layer. The stencil-forming layer is a blend of two grades of polyvinyl alcohol having different degrees of hydrolysis. The stencil-forming layer is imaged by dropwise application (for example using an ink-jet printer or plotter) of a cross-linking agent which hardens the stencil-forming layer to resist washing out with water. The hardened areas remaining after washing out are however sufficiently tacky for the washed-out film to adhere to the screen mesh by application of pressure and, after removal of the support base, form the stencil layer of a screen-printing screen.

64 Claims, 2 Drawing Sheets

U.S. PATENT DOCUMENTS

Figure 1:
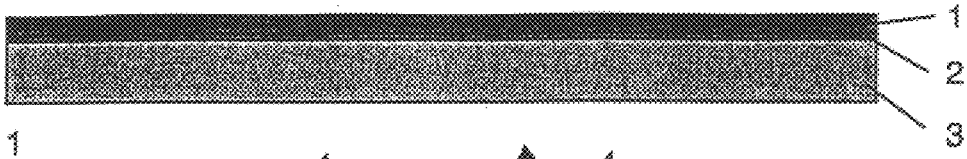

| | | | | |
|---|---|---|---|---|
| 4,538,156 | A | 8/1985 | Durkee et al. | 346/21 |
| 4,550,660 | A | 11/1985 | Sato et al. | 101/128.21 |
| 5,188,664 | A | 2/1993 | Adamic et al. | 106/22 R |
| 5,270,078 | A | 12/1993 | Walker et al. | 427/264 |
| 5,292,556 | A | 3/1994 | Ma et al. | 427/264 |
| 5,380,769 | A | 1/1995 | Titterington et al. | 523/161 |
| 5,466,653 | A | 11/1995 | Ma et al. | 427/264 |
| 5,654,032 | A | 8/1997 | Gybin et al. | 101/114 |
| 6,393,980 | B2 * | 5/2002 | Simons | 101/128.21 |

* cited by examiner

METHOD OF SCREEN PRINTING STENCIL PRODUCTION

CROSS REFERENCE TO RELATED APPLICATION

This is a continuation application of U.S. Ser. No. 09/250,188, filed Feb. 16, 1999, now abandoned, the entirety of which is incorporated herein by reference.

BACKGROUND TO THE INVENTION

1. Field of the Invention

The present invention relates to the production of stencils for screen printing.

2. Related Background Art

The production of screen printing stencils is generally well known to those skilled in the art.

One method, referred to as the "direct method" of producing screen printing stencils involves the coating of a liquid light-sensitive emulsion directly onto a screen mesh. After drying, the entire screen is exposed to actinic light through a film positive held in contact with the coated mesh in a vacuum frame. The black portions of the positive do not allow light to penetrate to the emulsion which remains soft in those areas. In the areas which are exposed to light, the emulsion hardens and becomes insoluble, so that, after washing out with a suitable solvent, the unexposed areas allow ink to pass through onto a substrate surface during a subsequent printing process.

Another method, referred to as the "direct/indirect method" involves contacting a film, consisting of a pre-coated unsensitised emulsion on a base support, with the screen mesh by placing the screen on top of the flat film. A sensitised emulsion is then forced across the mesh from the opposite side, thus laminating the film to the screen and at the same time sensitising its emulsion. After drying, the base support is peeled off and the screen is then processed and used in the same way as in the direct method.

In the "indirect method" a film base is pre-coated with a pre-sensitised emulsion. The film is exposed to actinic light through a positive held in contact with the coated film. After photochemical hardening of the exposed emulsion, the unexposed emulsion is washed away. The stencil produced is then mounted on the screen mesh and used for printing as described above for the direct method.

In the "capillary direct method" a pre-coated and pre-sensitised film base is adhered to one surface of the mesh by the capillary action of water applied to the opposite surface of the mesh. After drying, the film is peeled off and the screen then processed and used as described for the direct method.

In addition to the above methods, hand-cut stencils can be used. These are produced by cutting the required stencil design into an emulsion coating on a film base support. The cut areas are removed from the base before the film is applied to the mesh. The emulsion is then softened to cause it to adhere to the mesh. After drying, the base is peeled off. The screen is then ready for printing. This method is suitable only for simple work.

One problem generally associated with all the prior art methods is that many steps are necessary to produce the screen, thus making screen production time-consuming and labour-intensive.

Another problem is that normal lighting cannot be used throughout the screen production process in any of the methods except hand cutting. This is because the stencil materials are light-sensitive. In addition, it is necessary to provide a source of actinic (usually UV) light for exposing the stencil. This usually incurs a penalty of initial cost, space utilisation and ongoing maintenance costs.

Other methods of preparing printing screens are available. CA-A-2088400 (Gerber Scientific Products, Inc.) describes a method and apparatus in which a blocking composition is ejected directly onto the screen mesh surface in a pre-programmed manner in accordance with data representative of the desired image. The blocking composition directly occludes areas of the screen mesh to define the desired stencil pattern.

EP-A-0492351 (Gerber Scientific Products, Inc.) describes a method where an unexposed light-sensitive emulsion layer is applied to a screen mesh surface and a graphic is directly ink-jet printed on the emulsion layer by means of a printing mechanism to provide a mask through which the emulsion is exposed before the screen is further processed.

Both the above methods require the use of very specialised equipment (because of the need to handle large complete screens) which incurs a certain cost as well as imposing restrictions arising from the limitations of the equipment, in particular in terms of the size of screen and its resolution.

Ink-jet printers operate by ejecting ink onto a receiving substrate in controlled patterns of closely spaced ink droplets. By selectively regulating the pattern of ink droplets, ink-jet printers can be used to produce a wide variety of printed materials, including text, graphics and images on a wide range of substrates. In many ink-jet printing systems, ink is printed directly onto the surface of the final receiving substrate. An ink-jet printing system where an image is printed on an intermediate image transfer surface and subsequently transferred to the final receiving substrate is disclosed in U.S. Pat. No. 4,538,156 (AT&T Teletype Corp.). Furthermore, U.S. Pat. No. 5,380,769 (Tektronix Inc.) describes reactive ink compositions containing at least two reactive components, a base ink component and a curing component, that are applied to a receiving substrate separately. The base ink component is preferably applied to the receiving substrate using ink-jet printing techniques and, upon exposure of the base ink component to the curing component, a durable, crosslinked ink is produced.

One object of the present invention is to make screen-printing stencil production less time-consuming and labour-intensive.

Another object is to allow normal lighting to be used throughout the stencil production process and to avoid both the problems of prior art stencil materials which are light-sensitive and also the need to provide a source of actinic (usually UV) light for exposing the stencil.

SUMMARY OF THE INVENTION

The present invention provides a method of producing a screen-printing stencil having open areas and blocked areas for respectively passage and blocking of a printing medium, the method comprising:

providing a receptor element comprising an optional support base and a stencil-forming layer which is capable of reacting with a chemical agent applied thereto to produce areas of lower solubility where application takes place and to leave higher solubility areas elsewhere, the areas of lower solubility being sufficiently adherent for attachment of the receptor element to a screen-printing screen after washing away of the areas of higher solubility from the receptor element;

applying the said chemical agent imagewise to the stencil-forming layer in areas corresponding to the blocked stencil areas;

washing away the stencil-forming layer in the higher solubility areas;

bringing the receptor element into contact with the screen in order to attach it to the screen by the adherency thereto of the areas of lower solubility; and removing any remaining part of the receptor element in order to produce the screen-printing stencil.

In the method of the invention, the stencil is formed by chemical means without the need to use either special lighting conditions or actinic radiation.

Also, it is possible to carry out the method at reduced expenditure of time. and labour, compared with the known processes.

Advantageously, the chemical agent is applied dropwise to the stencil-forming layer.

Conveniently, the dropwise application is by use of an ink-jet device, for example an ink-jet printer or plotter. The device may have one or more ejection heads.

If desired, the chemical agent may be produced in situ by reaction between two or more precursor materials, separately applied to the stencil-forming layer, prior to contact with the stencil forming agent, at least one of which is applied in the said areas corresponding to the blocked areas of the stencil to be produced. This may conveniently be achieved by use of a plurality of drop-ejection heads.

When dropwise application is employed, the application is preferably controlled according to data encoding the desired pattern of blocked and open areas of the stencil to be produced. This control is conveniently by a computer, for example a personal computer. Thus, data representative of the desired output pattern can be input to a controller as pre-recorded digital signals which are used by the ejection head to deposit or not deposit the liquid containing the chemical agent as it scans the surface of the receptor element. The invention is not however restricted to dropwise application of the first chemical agent: other methods of application will achieve the same essential end, for example, the first chemical agent could be applied with a hand-held marker pen.

Preferably, the active component(s) of the chemical agent comprises one or more of:

boron salts, including boric acid, and Group I and Group II metal borates;

aldehydes, e.g. formaldehyde;

dialdehydes, e.g. glyoxal and glutaraldehyde, which may be activated by treatment with mineral acid;

isocyanates and their derivatives, including toluenediisocyanate;

carbodiimides and their derivatives, including pentahydroxy (tetradecanoate) dichromium and its derivatives; aziridine and its derivatives;

amines;

multifunctional silane compounds, including silicon tetraacetate;

N-methylol compounds, including dimethylolurea and methyloldimethylhydantoin; and active vinyl compounds, including 1,3,5-triacryloyl-hexahydro-s-triazine, optionally in a liquid solvent or carrier.

Advantageously, the active component(s) of the chemical agent constitutes from 0.5 to 100 wt. % of the chemical agent.

The invention also provides a pre-filled cartridge for a dropwise application device, for example an ink-jet printer or plotter, the cartridge containing one or more of the above chemical agents, optionally in a suitable liquid solvent or carrier.

For use in methods according to the invention, the invention also provides a receptor element comprising:

an optional support base;

a stencil-forming layer which is capable of reacting with a chemical agent applied thereto, to produce areas of lower solubility in a given solvent where application takes place and leave areas of higher solubility in the same solvent elsewhere, the areas of lower solubility being sufficiently adherent for attachment to a screen-printing screen to form thereon a stencil layer, after washing away of the areas of higher solubility.

The stencil-forming layer is preferably 5 to 20 $\mu$m in thickness, more preferably 6 to 15 $\mu$m.

Although not essential, the receptor element preferably has a support base which can be removed, preferably by peeling away, as a part of the receptor remaining after the receptor element has been applied to the screen.

The support base conveniently comprises polyethylene terrephthalate, polyethylene, polycarbonate, polyvinyl chloride, polystyrene or a coated paper, its thickness preferably being from 10 to 200 $\mu$m.

It is desirable for there to be a release layer between the support base and the stencil-forming layer. Suitable release layer comprise one or more of: polyurethanes, polyamides, polyesters, nitrile rubbers, chloroprene rubbers, polyvinyl acetate and polyacrylates.

The release layer is preferably from 0.1 to 5 $\mu$m in thickness, more preferably 0.5 to 1 $\mu$m.

Advantageously the stencil-forming layer comprises two or more different polymeric substances.

Preferably, the stencil-forming layer comprises two or more sub-layers, each of a respective different substance or blend of two or more different substances.

Particularly suitable materials comprise one or more of the following polymers:

polyvinylalcohol and its derivatives;

polyvinyl acetate;

gelatin and its derivatives;

carboxylated polymers capable of becoming water soluble on addition of alkali, including carboxylated acrylics, ethylene-acrylic acid and styrene-acrylic acid copolymers;

water-soluble cellulose derivatives, including starch and hydroxy propyl cellulose;

sulphonated polymers;

polyacrylamides;

epoxy resins; and amino resins, including urea-formaldehyde and melamine-formaldehyde.

It is particularly preferred that the stencil-forming layer comprises a blend of a first grade of polyvinyl alcohol, having a first, higher degree of hydrolysis, and a second grade of polyvinyl alcohol, having a second, lower degree of hydrolysis.

When the stencil-forming layer comprises two or more sub-layers, the outermost sub-layer preferably comprises a blend of a first grade of polyvinyl alcohol, having a first, higher degree of hydrolysis, and a second grade of polyvinyl alcohol having a second, lower degree of hydrolysis. Preferably, the next outermost sub-layer comprises a blend of polyvinyl alcohol and polyvinyl acetate.

Advantageously, the first and second degrees of hydrolysis fall within the ranges 86% to 92% and 76% to 82%, respectively.

Preferably, the ratio by weight of the first to the second grade of polyvinyl alcohol falls within the range of from 1:9 to 9:1, more preferably in the range of from 1:3 to 3:1.

Advantageously, the number average molecular weight of the first grade of polyvinyl alcohol is lower than that of the second grade.

DETAILED DESCRIPTION OF THE INVENTION

Figure 2:
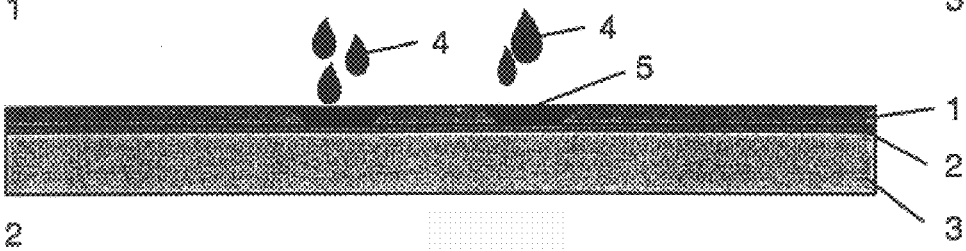
Figure 4:
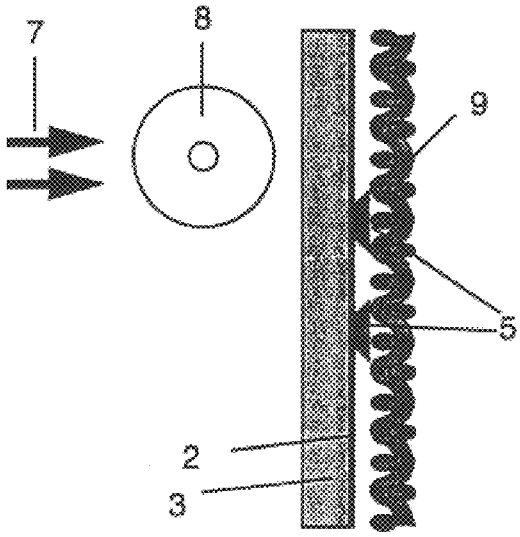
Figure 5:
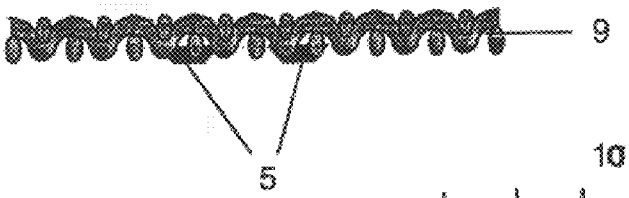
Figure 6:
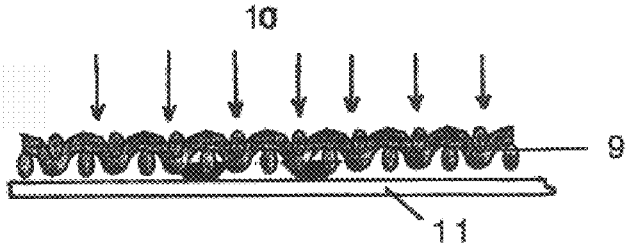
Figure 7:
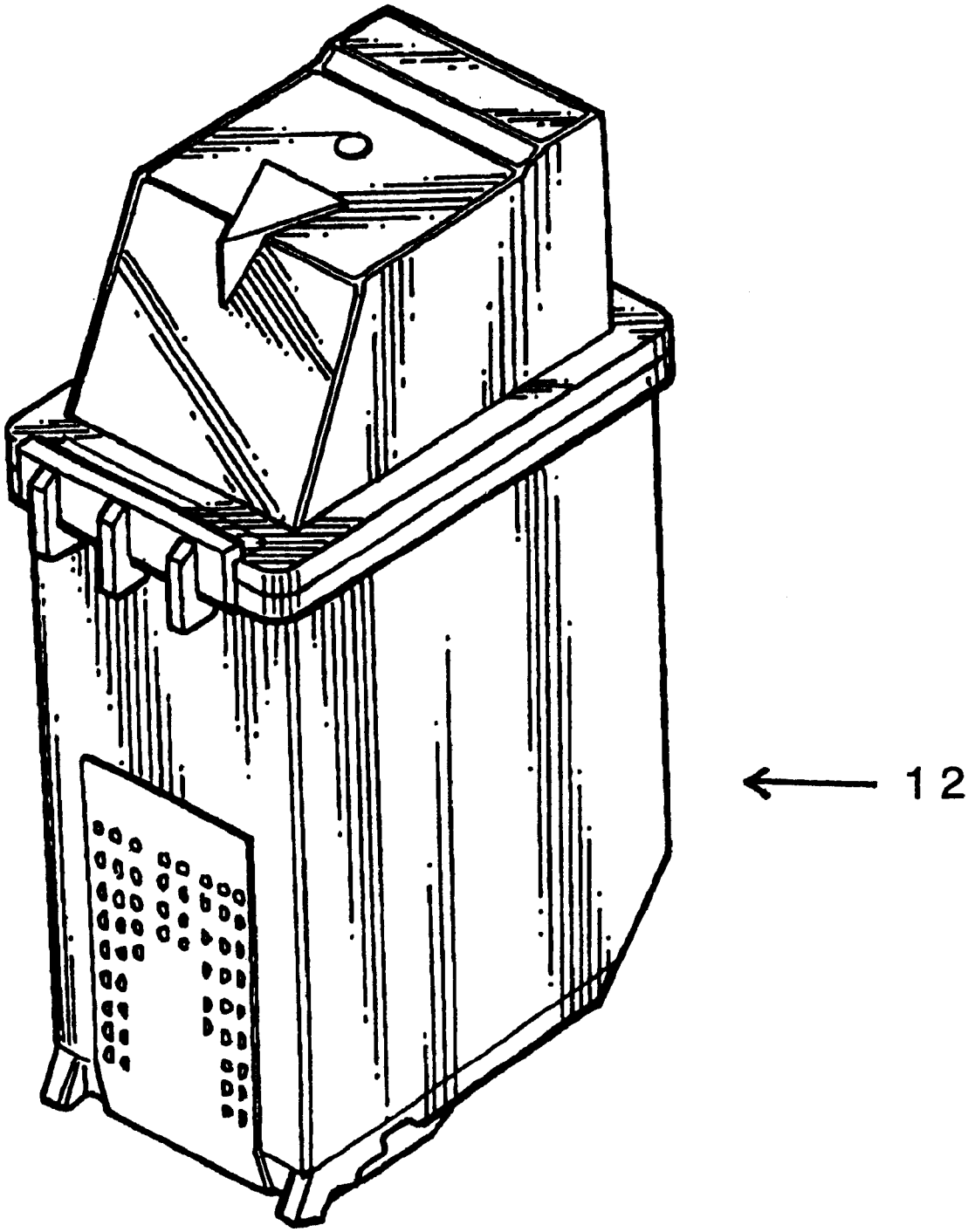

The invention will be described further by way of example with reference to the drawings of this specification, in which FIGS. 1 to 5 show schematically the successive steps in the production of a printing screen in accordance with the invention;

FIG. 6 shows schematically the screen produced according to FIGS. 1 to 5 in use in printing onto a substrate; and FIG. 7 is a perspective view of a cartridge for use in an ink-jet printer or plotter and pre-filled with a liquid such as is applied to the receptor element shown in FIG. 2 of the drawings.

Figure 3:
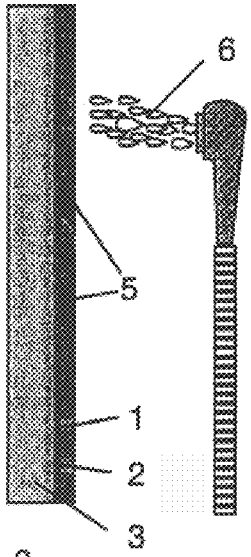

Referring to FIGS. 1 to 6, these show the formation of a screen printing stencil shown in FIG. 5, starting with a receptor element shown in FIG. 1.

The receptor element shown in FIG. 1 comprises a polyethylene terephthalate support base 3 of about 75 μm thickness. This is coated with a release layer 2 of polyurethane resin of about 0.5 to 1 μm thickness. A stencil-forming layer 1 of about 12 μm thickness overlies the release layer 2.

FIG. 2 of the drawings shows the receptor element being imaged by the dropwise application of a chemical agent 4 in areas 5 of the stencil-forming layer 1 which correspond to the closed areas of the stencil to be produced.

Imagewise application of the chemical agent 4, as shown in FIG. 2, causes a hardening reaction in the stencil-forming layer 1 of the receptor element in the areas to which the chemical agent was applied.

FIG. 3 shows the receptor element being washed out by water 6 applied using a spray head. The hardened areas 5 are insoluble in the water 6 and resist washing out. The remaining areas of the stencil-forming layer 1 are washed away during this process in order to produce areas corresponding to the open areas of the finished stencil.

After washing out as shown in FIG. 3, the surface of the stencil-forming layer in the areas 5 to which the chemical agent 4 was applied is sufficiently soft or tacky for the receptor element to adhere to the mesh of a screen printing screen.

FIG. 4 shows this step being carried out: the receptor element is placed in contact with a screen mesh with the soft surface of the stencil-forming layer facing the mesh 9. A roller 8 is used to apply pressure in the direction of the arrows 7 in FIG. 4 in order to laminate the receptor element to the mesh 9.

Once the stencil-forming layer has been adhered to the mesh 9, the support base 3 can be peeled away. This is facilitated by the release layer 2. After peeling away of the support base 3, the final stencil as shown in FIG. 5 results, the closed areas 5 being formed by the hardened yet tacky areas 5 of the stencil-forming layer 1.

FIG. 6 shows the final stencil of FIG. 5 in use in printing ink 10 onto a suitable printing substrate 11, for example paper.

EXAMPLES

The present invention is illustrated by the following examples without however being limited thereto. In these examples, various commercially-available materials are listed by their trade names; the following letters identifying the following companies:

(a) Stahl Limited, UK (b) Nippon Gohsei, Japan (c) Resadhesion Limited, Hampshire, UK (d) Ciba-Geigy, UK (e) W R Grace, Germany (f) DuPont, UK (g) Autotype International Limited, UK

Example 1

Polyethylene terephthalate film base of 75 μm thickness was coated with a layer of the following dispersion at a thickness of 0.5 to 1 μm using 0.010 in Meyer bar, in order to provide a release layer:

| | wgt % |
|---|---|
| "Permuthane UE 41500" (a) polyurethane resin | 1 |
| de-ionised water | 99 |

The coated film base was then coated on the release layer side with the following first coating composition to a thickness of 8 μm using a 0.050 in Meyer bar:

| | wgt % |
|---|---|
| "Gohsenol KH-17" (b): an aqueous solution containing 15 wgt % polyvinyl alcohol having a degree of hydrolysis of 78% | 82 |
| "Resadhesion A1350" (c): an aqueous emulsion containing 50 wgt % polyvinyl acetate | 12 |
| "Unisperse Red" (d) pigment dispersion | 1 |
| "Syloid ED-2" (e) treated silica with 2 to 3 μm average particle size | 1 |
| de-ionised water | 1 |

The first coating composition was dried using a warm fan operating at 40° C. to give a first coating layer on the polyethylene terephthalate film base. The following second coating composition was then coated onto the first coating layer to a thickness of 5 μm using a 0.020 in Meyer bar:

| | wgt % |
|---|---|
| "Gohsenol KH-17" as above | 73 |
| "Gohsenol GL-03" (b): an aqueous solution containing 30 wgt % polyvinyl alcohol of lower molecular weight than "KH-17" and a degree of hydrolysis of 88% | 12 |
| "Unisperse Red" | 3 |
| de-ionised water | 12 |

The coated composition was dried using a warm air fan operating a 40° C. to give a receptor element having a two-layer stencil forming coating. The following imaging composition was prepared and introduced to an ink-jet printer cartridge suitable for use in a Hewlett Packard 550 ink-jet printer.

| | wgt % |
|---|---|
| potassium tetraborate tetrahydrate | 7 |
| diethylene glycol (humectant) | 2 |
| de-ionised water | 91 |

The cartridge was fitted to the printer which was connected to a personal computer, under the control of which the coated surface of the receptor element was imaged with the coating composition. The computer control of the imaging was such that coating took place in areas of the film which, in the final stencil, were to be closed areas (this is known as "negative working"). The potassium tetraborate cross-linking agent is believed to react with the polyvinyl alcohol in these areas to form a matrix of the two polymers and thereby produce areas of reduced solubility in water corresponding to the closed stencil areas. After removal from the printer, the imaged film was dried using a hot-air fan. The imaged and dried receptor element was then washed-out using a fine cold-water spray. During the washing-out, the coated polymers in the non-imaged areas were washed away to produce open areas corresponding to the open areas of the stencil to be produced. A screen-printing screen having a frame and a mesh size of 90 threads per cm was abraded using Autoprep Gel (g) (a screen abrasive consisting of finely dispersed aluminium oxide in a base emulsion) and wetted with a water spray. In order to laminate the film to the screen, a sheet of absorbent paper was first laid on the surface of a flat and raised pad of dimensions to fit within the screen frame. The freshly rinsed receptor element was laid on the paper sheet with its coated side uppermost. The screen was then placed on top of the film. Applying firm pressure to the mesh using a soft paint roller, the screen was forced into contact with the coated film and excess moisture from the screen and coating expelled. Excess moisture was then removed from the film side of the screen by lifting the screen from the raised pad. The screen was dried using a hot-air fan and the base film peeled away to leave the final screen-printing screen. The final screen was robust with no reticulation and was found capable of printing more than 500 copies on paper using a commercial screen-printing ink.

Example 2

Example 1 was repeated exactly except that the following imaging composition was prepared and used:

| | wgt % |
|---|---|
| "Quilon C" (f): 30 wgt % solution of pentahydroxy (tetradecanote) dichromium in isopropanol | 10 |
| acetone/isopropanol (1:1 by weight) | 90 |

The final screen was again robust with no reticulation and was found capable of printing more than 500 copies on paper using a commercial screen-printing ink.

Example 3

Example 1 was repeated exactly except that the following single coating composition was used instead of the first and second coating compositions of example 1.

| | wgt % |
|---|---|
| "Gohsenol KH-17" (a): as above | 48.5 |
| "Gohsenol GL-03" (a) as above | 48.5 |
| "Unisperse Red" | 2 |
| "Syloid ED-2" | 1 |

This composition was coated on the sub-layer of example 1 at a coating thickness of 11 $\mu$m using a 0.065 in Meyer bar. The final screen was robust with no reticulation and was found capable of printing more than 500 copies on paper using a commercial screen-printing ink.

Example 4

Example 3 was repeated exactly except that the single coating composition used was as follows:

| | wgt % |
|---|---|
| "Gohsenol KH-17" (a) as above | 97 |
| "Unisperse Red" | 2 |
| "Syloid ED-2" | 1 |

and the following imaging solution was used:

| | wgt % |
|---|---|
| potassium tetraborate tetrahydrate | 1 |
| diethylene glycol | 2 |
| de-ionised water | 97 |

The final screen was robust with no reticulation and was found capable of printing more than 500 copies on paper using a commercial screen-printing ink.

Referring to FIG. 7 of the drawings, this shows a cartridge 12 for use in an ink-jet printer or plotter and pre-filled with a liquid such as is applied to the receptor element in the above description with reference FIGS. 1 to 5 of the drawings.

It should be understood that the invention is not limited to the particular embodiments shown and described herein but that various changes and modifications may be made without departing from the scope and spirit of the invention.

We claim:

1. A method of producing a screen-printing stencil comprising a foraminous screen having thereon a stencil layer which is interrupted to form open areas and blocked areas for respectively passage and blocking of a printing medium through the screen and onto a printing substrate, the method comprising the steps of:

(a) providing a receptor element comprising a continuous support base and a stencil-forming layer which is capable of reacting with a chemical agent applied thereto, the chemical agent comprising at least one active component which reacts with the stencil-forming layer upon said application to produce areas of lower solubility where application takes place and to leave higher solubility areas elsewhere, the areas of lower solubility being sufficiently adherent for attachment of the receptor element to the foraminous screen after washing away of the areas of higher solubility from the receptor element;

(b) applying the said chemical agent imagewise to the stencil-forming layer in areas corresponding to the blocked areas of the stencil layer in order to produce by the said reaction between the said at least one active component of the chemical agent and the stencil forming layer the said areas of lower solubility where the said reaction takes place and to leave the said areas of higher solubility where no said reaction takes place;

(c) washing away the stencil-forming layer from the continuous support base in the higher solubility areas to produce a washed-out stencil;

(d) attaching the receptor element comprising the continuous support base and the washed-out stencil to the foraminous screen by bringing the washed-out stencil-forming layer of the receptor element into contact with the foraminous screen, whereby the receptor element becomes attached to the foraminous screen by the adherency thereto of the lower-solubility areas of the stencil-forming layer; and (e) removing the support base of the receptor element in order to produce the screen-printing stencil.

2. A method according to claim 1, wherein the chemical agent is applied dropwise to the receptor element.

3. A method according to claim 2, wherein the dropwise application is by an ink-jet printer.

4. A method according to claim 2, wherein the dropwise application is by an ink-jet plotter.

5. A method according to claim 1, wherein the chemical agent is applied to the receptor element by a hand-held delivery device.

6. A method according to claim 1, wherein the active component(s) of the chemical agent constitutes from 0.5 to 100 wt. % of the chemical agent.

7. A method according to claim 1, wherein the active component(s) of the chemical agent are carried in a liquid carrier.

8. A method according to claim 1, wherein the active component(s) of the chemical agent are dissolved in a liquid solvent.

9. A method according to claim 1, wherein the active component(s) of the chemical agent comprise one or more boron salts.

10. A method according to claim 1, wherein the active component(s) of the chemical agent comprises boric acid.

11. A method according to claim 1, wherein the active component(s) of the chemical agent is/are selected from the group consisting of Group I and Group II metal borates.

12. A method according to claim 1, wherein the active component(s) of the chemical agent comprise one or more aldehydes.

13. A method according to claim 1, wherein the active component(s) of the chemical agent comprises formaldehyde.

14. A method according to claim 1, wherein the active component(s) of the chemical agent comprises one or more dialdehydes.

15. A method according to claim 14, wherein the dialdehyde(s) is/are treated as mineral acid.

16. A method according to claim 1, wherein the active component(s) of the chemical agent is/are selected from the group consisting of glyoxal and glutaraldehyde.

17. A method according to claim 1, wherein the active component(s) of the chemical agent comprises one or more compounds selected from the group consisting of isocyanates and isocyanate derivatives.

18. A method according to claim 1, wherein the active component(s) of the chemical agent comprises toluenediisocyanate.

19. A method according to claim 1, wherein the active component(s) of the chemical agent comprises one or more compounds selected from the group consisting of carbodiimides and carbodiimide derivatives.

20. A method according to claim 1, wherein the active component(s) of the chemical agent comprise one or more compounds selected from the group consisting of pentahydroxy(tetradecanoate)dichromium and pentahydroxy(tetradecanoate)dichromium derivatives.

21. A method according to claim 1, wherein the active component(s) of the chemical agent comprise one or more compounds selected from the ground consisting of aziridine and aziridine derivatives.

22. A method according to claim 1, wherein the active component(s) of the chemical agent comprise one or more amines.

23. A method according to claim 1, wherein the active component(s) of the chemical agent comprise one or more multifunctional silane compounds.

24. A method according to claim 1, wherein the active component(s) of the chemical agent comprise silicon tetraacetate.

25. A method according to claim 1, wherein the active component(s) of the chemical agent comprise one or more N-methylol compounds.

26. A method according to claim 1, wherein the active component(s) of the chemical agent comprise one or more compounds selected from the group consisting of dimethylolurea and methyloldimethylhydantoin.

27. A method according to claim 1, wherein the active component(s) of the chemical agent comprise one or more active vinyl compounds.

28. A method according to claim 1, wherein the active component(s) of the chemical agent comprise 1,3,5-triacryloyl-hexahydro-s-triazine.

29. A method according to claim 1, wherein the support base comprises polyethylene terephthalate, polyethylene, polycarbonate, polyvinyl chloride, polystyrene or a coated paper.

30. A method according to claim 1, wherein the support base is from 10 to 200 $\mu$m in thickness.

31. A method according to claim 1, wherein the receptor element has a support base release layer between the support base and the stencil-forming layer.

32. A method according to claim 31, wherein the release layer is from 0.1 to 5 $\mu$m in thickness.

33. A method according to claim 31, wherein the release layer is from 0.5 to 1 $\mu$m in thickness.

34. A method according to claim 31, wherein the release layer comprises one or more polymers selected from the group consisting of: polyurethanes, polyamides, polyesters, nitrile rubbers, chloroprene rubbers, polyvinyl acetate and polyacrylates.

35. A method according to claim 1, wherein the stencil-forming layer is from 5 to 20 $\mu$m in thickness.

36. A method according to claim 1, wherein the stencil-forming layer is from 6 to 15 $\mu$m in thickness.

37. A method according to claim 1, wherein the stencil-forming layer comprises two or more different polymeric substances.

38. A method according to claim 37, wherein the stencil-forming layer comprises a blend of a first grade of polyvinyl alcohol, having a first, higher degree of hydrolysis, and a second grade of polyvinyl alcohol, having a second, lower degree of hydrolysis.

39. A method according to claim 38, wherein the first and second degrees of hydrolysis fall within the ranges of from 86% to 92% and from 76% to 82%, respectively.

40. A method according to claim 38, wherein the ratio by weight of the first to the second grade of polyvinyl alcohol falls within the range of from 1:9 to 9:1.

41. A method according to claim 38, wherein the ratio by weight of the first to the second grade of polyvinyl alcohol falls within the range of from 1:3 to 3:1.

42. A method according to claim 38, wherein the number average molecular weight of the first grade of polyvinylalcohol is lower than that of the second grade.

43. A method according to claim 1, wherein the stencil-forming layer comprises two or more sub-layers, one of which constitutes an outer sub-layer of the stencil-forming layer and another of which constitutes a next outermost sub-layer of the stencil-forming layer, each of the said sub-layers being of a respective different substance or blend of two or more different substances.

44. A method according to claim 43, wherein the outermost sub-layer comprises a blend of a first grade of polyvinyl alcohol, having a first, higher degree of hydrolysis, and a second grade of polyvinyl alcohol having a second, lower degree of hydrolysis.

45. A method according to claim 44, wherein the first and second degrees of hydrolysis fall within the ranges of from 86% to 92% and from 76% to 82%, respectively.

46. A method according to claim 44, wherein the next outermost sub-layer comprises a blend of polyvinyl alcohol and polyvinyl acetate.

47. A method according to claim 44, wherein the ratio by weight of the first to the second grade of polyvinyl alcohol falls within the range of from 1:9 to 9:1.

48. A method according to claim 44, wherein the ratio by weight of the first to the second grade of polyvinyl alcohol falls within the range of from 1:3 to 3:1.

49. A method according to claim 44, wherein the number average molecular weight of the first grade of polyvinylalcohol is lower than that of the second grade.

50. A method according to claim 1, wherein the stencil-forming layer comprises one or more polymers selected from the group consisting of polyvinylalcohol, polyvinylalcohol derivatives and polyvinyl acetate.

51. A method according to claim 1, wherein the stencil-forming layer comprises one or more polymers selected from the group consisting of gelatin and gelatin derivatives.

52. A method according to claim 1, wherein the stencil-forming layer comprises one or more polymers selected from the group consisting of carboxylated polymers capable of becoming water soluble on addition of alkali.

53. A method according to claim 52 wherein the stencil-forming layer comprises, as a carboxylated polymer capable of becoming water soluble on addition of alkali, a carboxylated acrylic polymer.

54. A method according to claim 52, wherein the stencil-forming layer comprises, as a carboxylated polymer capable of becoming water soluble on addition of alkali, an ethylene-acrylic acid copolymer.

55. A method according to claim 52, wherein the stencil-forming layer comprises, as a carboxylated polymer capable of becoming water soluble on addition of alkali, a styrene-acrylic acid copolymer.

56. A method according to claim 1, wherein the stencil-forming layer comprises one or more polymers selected from the group consisting of water-soluble cellulose derivatives.

57. A method according to claim 56, wherein the stencil-forming layer comprises, as a water-soluble cellulose derivative, starch.

58. A method according to claim 56, wherein the stencil-forming layer comprises, as a water-soluble cellulose derivative, hydroxypropyl cellulose.

59. A method according to claim 1, wherein the stencil-forming layer comprises one or more polymers selected from the group consisting of sulphonated polymers.

60. A method according to claim 1, wherein the stencil-forming layer comprises one or more polymers selected from the group consisting of polyacrylamides.

61. A method according to claim 1, wherein the stencil-forming layer comprises one or more polymers selected from the group consisting of epoxy resins.

62. A method according to claim 1, wherein the stencil-forming layer comprises one or more polymers selected from the group consisting of amino resins.

63. A method according to claim 62, wherein the stencil-forming layer comprises, as an amino resin, a urea-formaldehyde resin.

64. A method according to claim 62, wherein the stencil-forming layer comprises, as an amino resin, a melamine-formaldehyde resin.

* * * * *